US007347747B2

(12) United States Patent
Shimizu

(10) Patent No.: US 7,347,747 B2
(45) Date of Patent: Mar. 25, 2008

(54) TERMINAL FITTING WITH A RESILIENT REINFORCING PIECE

(75) Inventor: Tooru Shimizu, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 11/644,653

(22) Filed: Dec. 22, 2006

(65) Prior Publication Data

US 2007/0149068 A1 Jun. 28, 2007

(30) Foreign Application Priority Data

Dec. 26, 2005 (JP) ..... 2005-373112

(51) Int. Cl.
*H01R 11/22* (2006.01)
*H01R 13/11* (2006.01)

(52) U.S. Cl. ..... 439/852; 439/842

(58) Field of Classification Search ..... 439/852, 439/581, 842, 877, 862, 595, 878
See application file for complete search history.

(56) References Cited

U.S. PATENT DOCUMENTS 3,670,298 A * 6/1972 Klumpp, Jr. ..... 439/877
4,919,628 A * 4/1990 Mobley et al. ..... 439/858
5,630,738 A * 5/1997 Ito et al. ..... 439/852
5,702,272 A 12/1997 Machida ..... 439/843
6,042,433 A * 3/2000 Chen ..... 439/852
6,206,727 B1 * 3/2001 Aoyama et al. ..... 439/585
6,468,116 B2 * 10/2002 Koide ..... 439/867
6,547,608 B2 * 4/2003 Sato et al. ..... 439/852
6,692,303 B2 2/2004 Fukatsu ..... 439/595
6,971,927 B2 * 12/2005 Anbo et al. ..... 439/852
7,156,704 B2 * 1/2007 Shimizu ..... 439/852
2007/0010140 A1 * 1/2007 Fukaya et al. ..... 439/852
2007/0111614 A1 * 5/2007 Tanaka ..... 439/852

FOREIGN PATENT DOCUMENTS

JP 03-093176 4/1991
JP 05-258832 10/1993
JP 09-289056 11/1997
JP 11-224709 8/1999

* cited by examiner

*Primary Examiner*—Hae Moon Hyeon
(74) *Attorney, Agent, or Firm*—Gerald E. Hespos; Anthony J. Casella

(57) ABSTRACT

A rectangular tube (10) is formed such that a pair of side plates (12L, 12R) stand up from the opposite left and right edges of a bottom plate (11) and an extending end of an upper plate (13) extending from the upper edge of the left side plate (12L) substantially in parallel with the bottom plate is placed in contact with the upper end surface of the right side plate (12R). The upper plate (13) has an embossment (18R) projecting in and a pressing portion (14) extending from the upper edge of the right side plate (12R) is placed into contact with the upper surface of the embossment (18R) to prevent an upward movement of the upper plate (13). Thus, the height of the rectangular tube (10) can be reduced by a recessed dimension of the embossment (18R).

15 Claims, 16 Drawing Sheets

TERMINAL FITTING WITH A RESILIENT REINFORCING PIECE

BACKGROUND OF THE INVENTION

1. Field of the Invention

The invention relates to a terminal fitting.

2. Description of the Related Art

Japanese Unexamined Patent Publication No. 2003-092161 discloses a terminal fitting having a rectangular tube with a bottom plate. First and second side plates stand up at right angles from the opposite first and second edges of the bottom plate. An upper plate extends from the upper edge of the first side plate substantially in parallel with the bottom plate, and the extending end of the upper plate contacts the upper end surface of the second side plate.

A terminal fitting of this kind may also have a pressing portion extending from the upper edge of the second side plate and substantially parallel to the bottom plate. The pressing portion is placed on the upper surface of the upper plate to prevent an upward movement of the upper plate. This construction has a problem of making the rectangular tube bulky because the upper plate and the pressing portion are placed one over the other.

The present invention was developed in view of the above problem and an object thereof is to reduce the height of a tube.

SUMMARY OF THE INVENTION

The invention relates to a terminal fitting having a tube for receiving a mating terminal. The tube includes a bottom plate, first and second side plates projecting from the opposite lateral edges of the bottom plate, and a upper plate extending from the distal end of the first side plate having an extending end in direct or indirect contact with the distal end of the second side plate. The terms bottom and upper are used herein as a convenient frame of reference, and are not intended to imply a required gravitational orientation. The upper plate has at least one embossment projecting in to define a step or recess. At least one pressing portion extends from the distal edge of the second side plate and is placed in contact with the outer surface of the embossment to prevent an outward movement of the upper plate. Thus, the height of the tube can be reduced by a recessed dimension of the embossment.

The pressing portion preferably extends from the distal edge of the second side plate substantially in parallel with the bottom plate.

The embossment and/or the pressing portion may be thinned. Thus, the height of the tube can be further reduced by the thinned dimension.

The inner surface of the embossment preferably is a contact surface with the mating terminal. Thus, the shape of the upper plate is simpler as compared to a case where the embossment is separate from the contact means with the mating terminal.

The inner surfaces of the embossment and the extending end of the upper plate preferably are substantially continuous and flush with each other. Thus, the shape of the upper plate is simpler as compared to a case where the inner surface of the embossment is lower than that of the extending end of the upper plate to have a stepped configuration.

Most preferably, the embossment is thinner than the upper plate.

The tube preferably has a resilient contact piece and a resilient reinforcing piece that are in contact only at respective embossed contacts.

An escaping hole preferably is formed in the resilient reinforcing piece so that a portion of the resilient contact piece can enter the escaping hole to avoid interference of the resilient contact piece and one of the plates when the resilient contact piece is deformed by the mating terminal.

One or more projection-shaped contacts preferably are provided at one or both of the upper plate and the second side plate and are engageable with projections on the other of the upper plate and the second side plate.

Inner surfaces of the embossment and the contacts at the extending end of the upper plate preferably are continuous and flush with each other.

A forwardly projecting resilient reinforcing piece preferably is formed on the bottom plate and has an inward inclination. An escaping hole is formed in a widthwise intermediate position of the front end of the resilient reinforcing piece. A guiding projection is insertable into the escaping portion and is substantially flush with the bottom plate. The guiding projection can enter the escaping portion of the resilient reinforcing piece. At least the rear edge of the guiding projection is substantially flush with the bottom plate and is located behind the front edge of the resilient reinforcing piece.

The terminal fitting preferably has a wire crimping portion comprising a plurality of crimping pieces displaced along the longitudinal direction of the wire. The strength of the rearmost crimping piece preferably is increased as compared to that of the forward crimping piece(s).

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
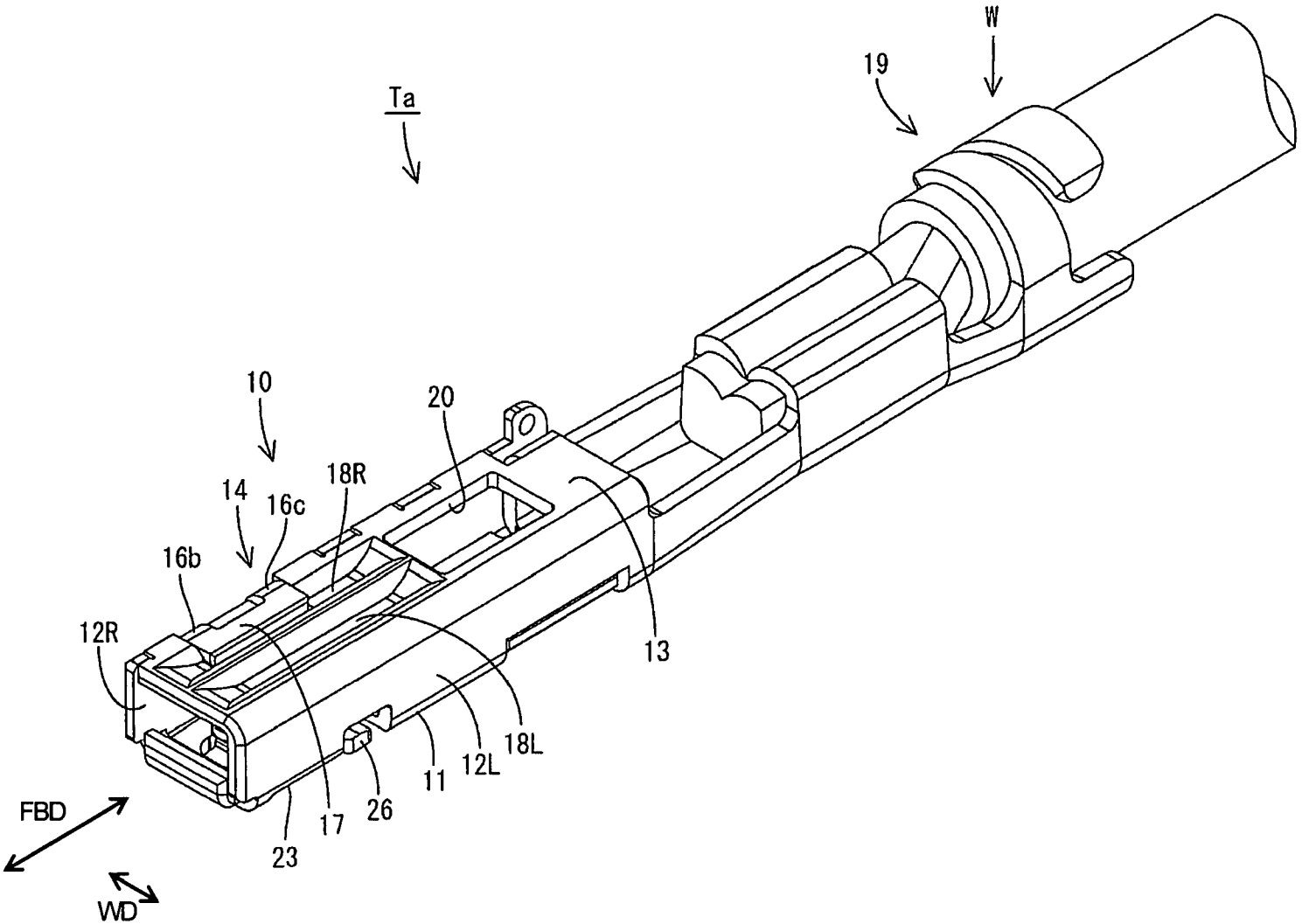
FIG. 1 is a perspective view of a first embodiment when obliquely viewed from front.
Figure 2:
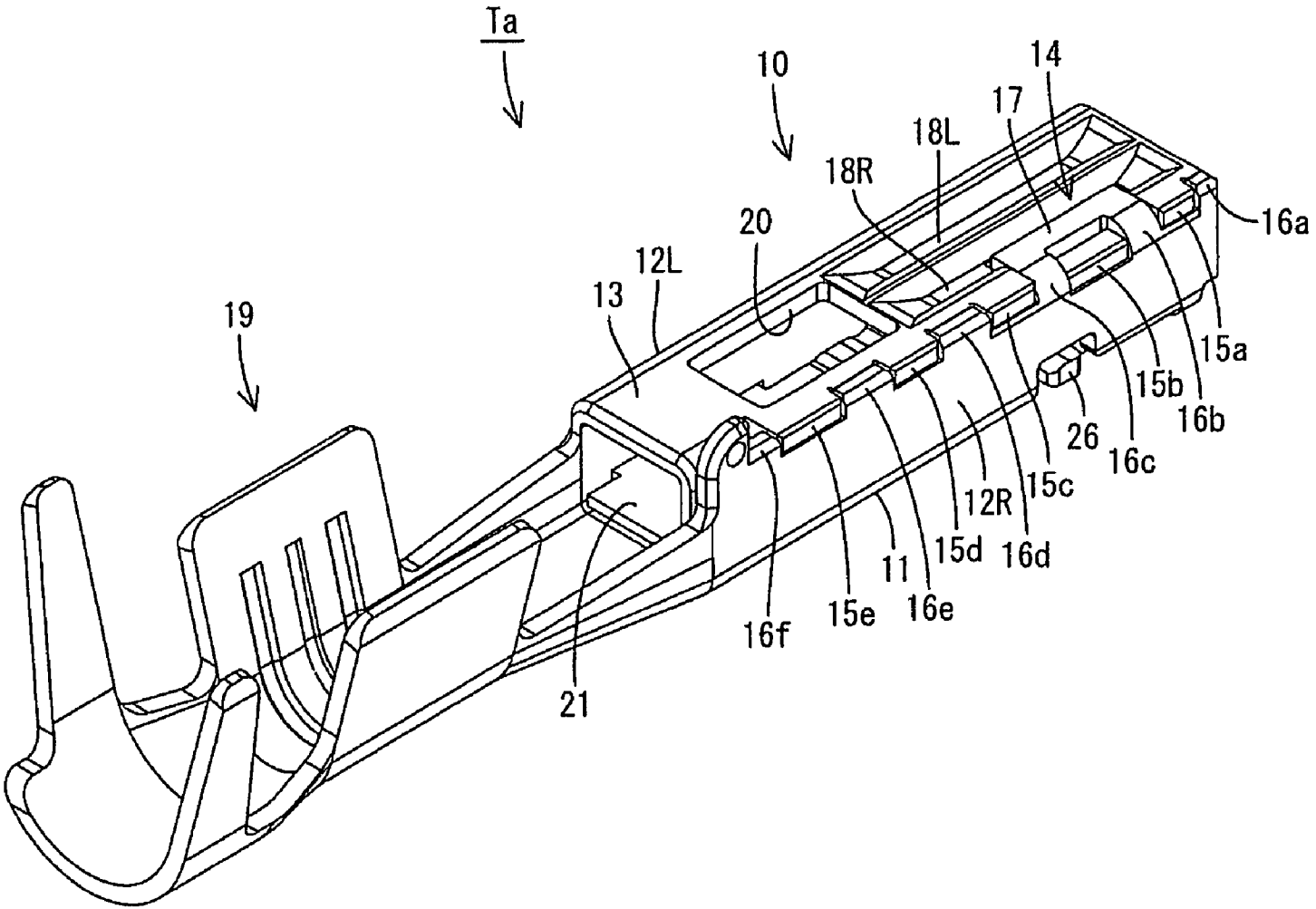
FIG. 2 is a perspective view of the first embodiment when obliquely viewed from behind.
Figure 3:
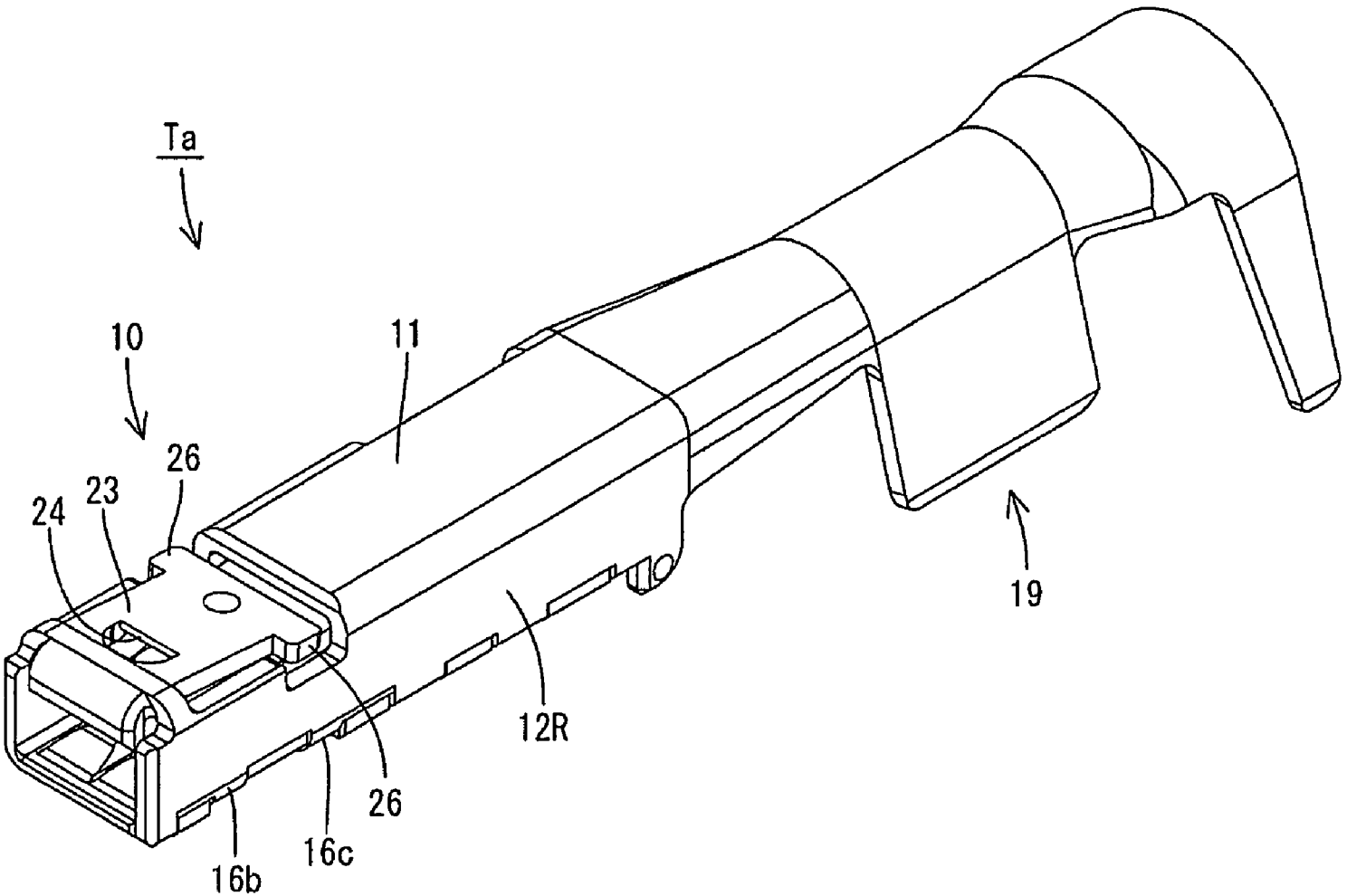
FIG. 3 is a perspective view of the first embodiment in an upside-down state when obliquely viewed from front.
Figure 4:
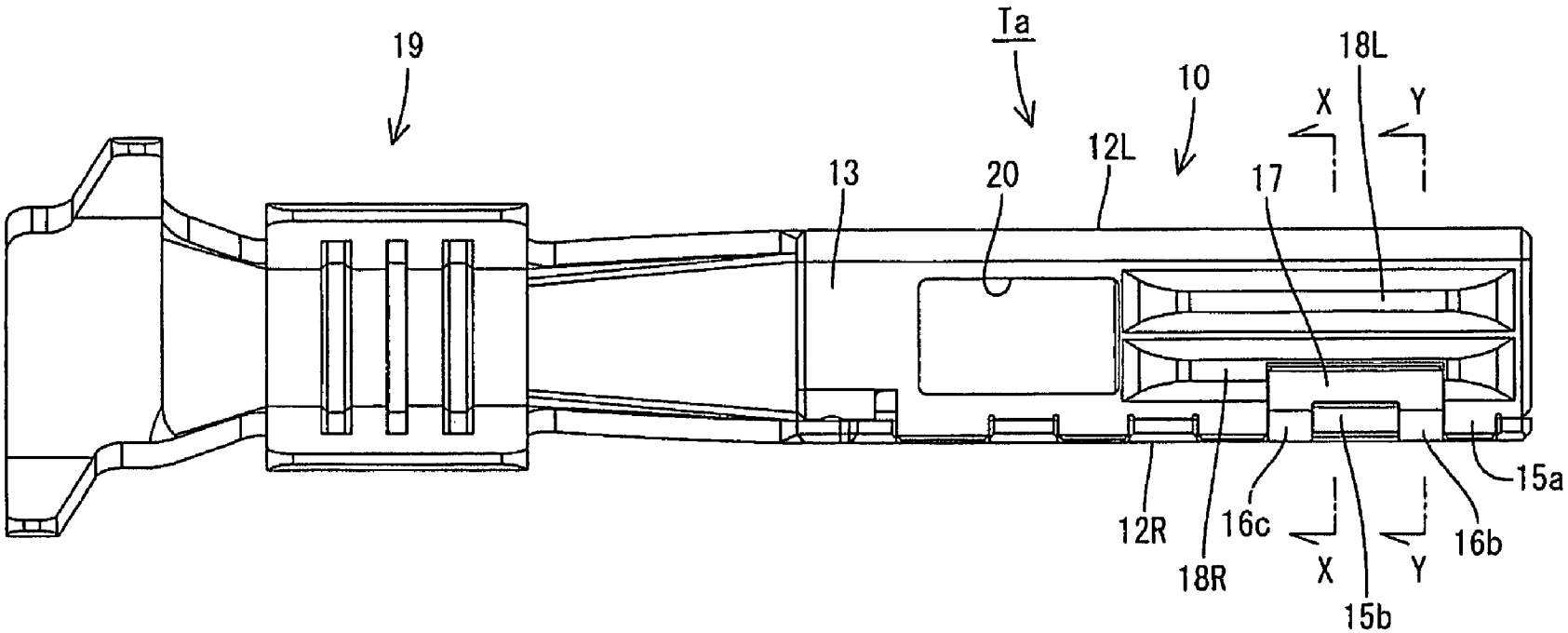
FIG. 4 is a plan view of the first embodiment.
Figure 5:
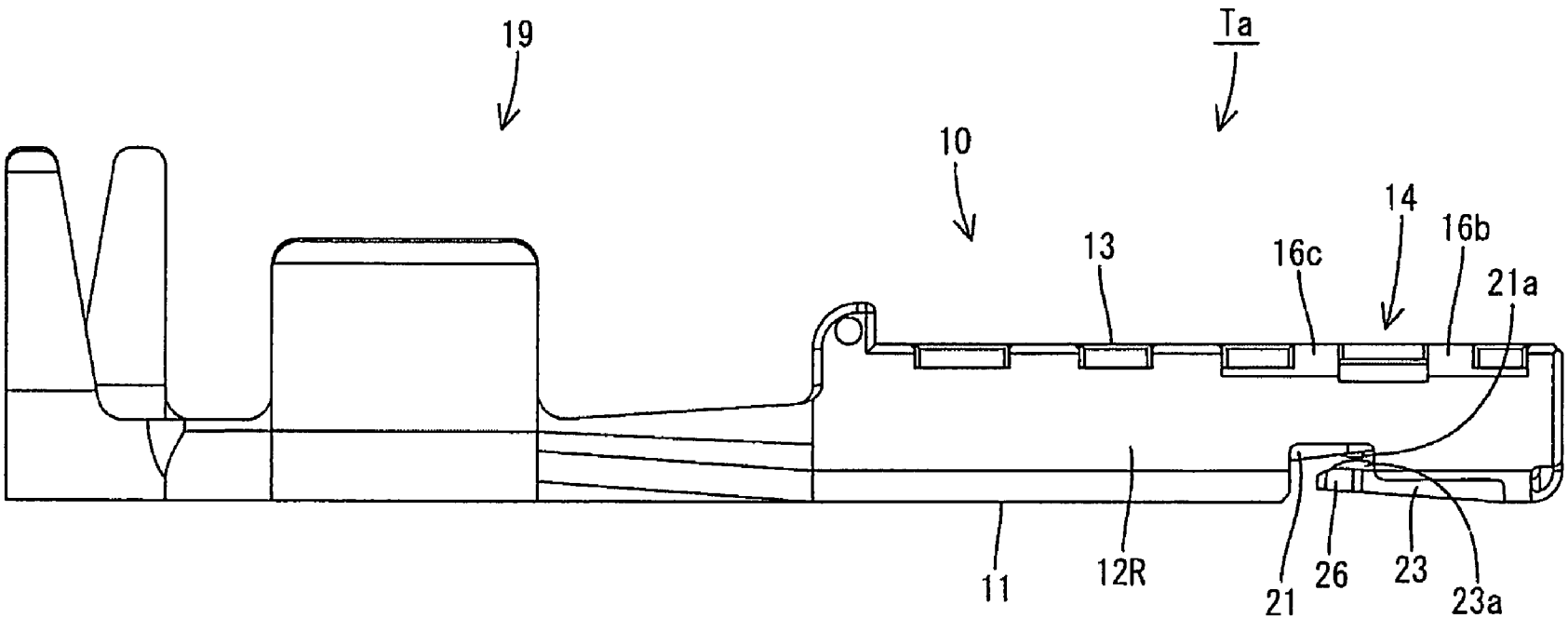
FIG. 5 is a side view of the first embodiment.
Figure 6:
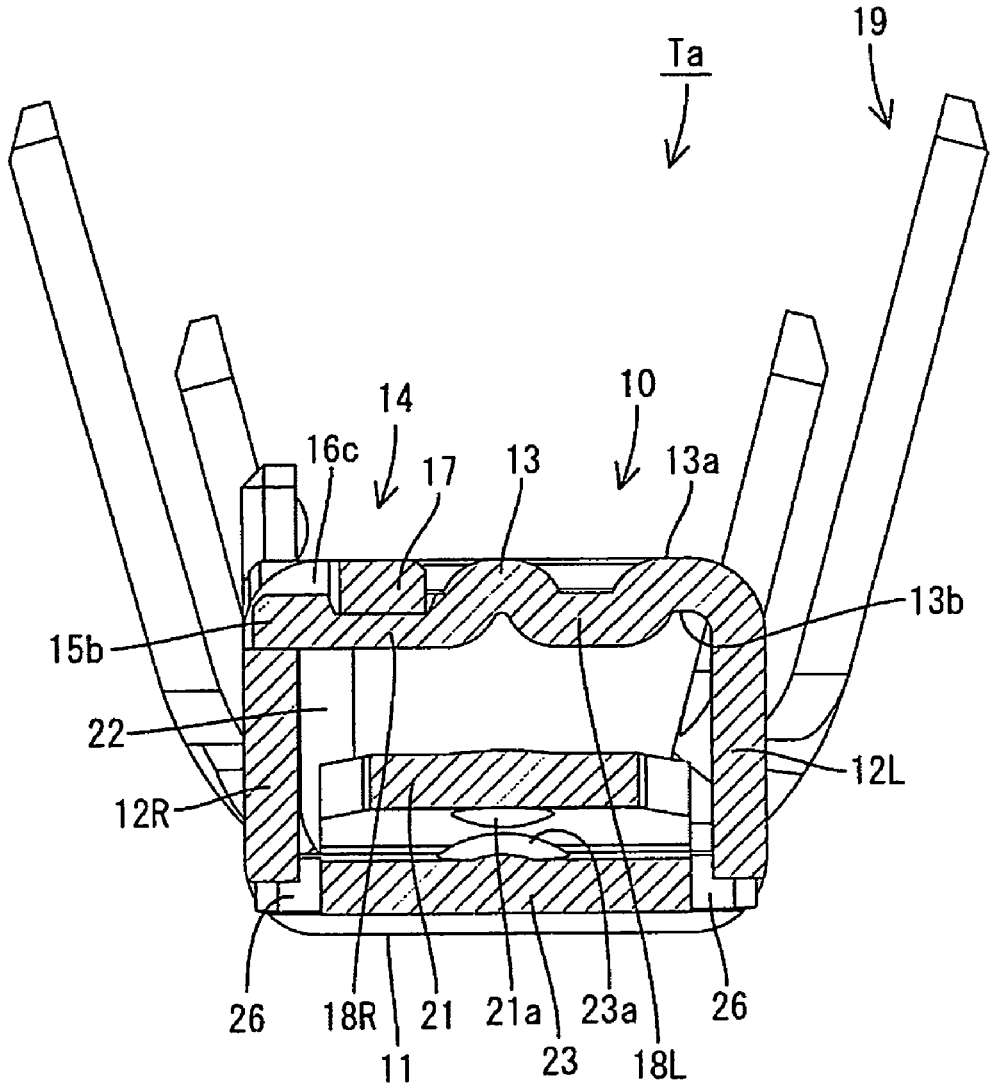
FIG. 6 is a section along X-X of FIG. 4.
Figure 7:
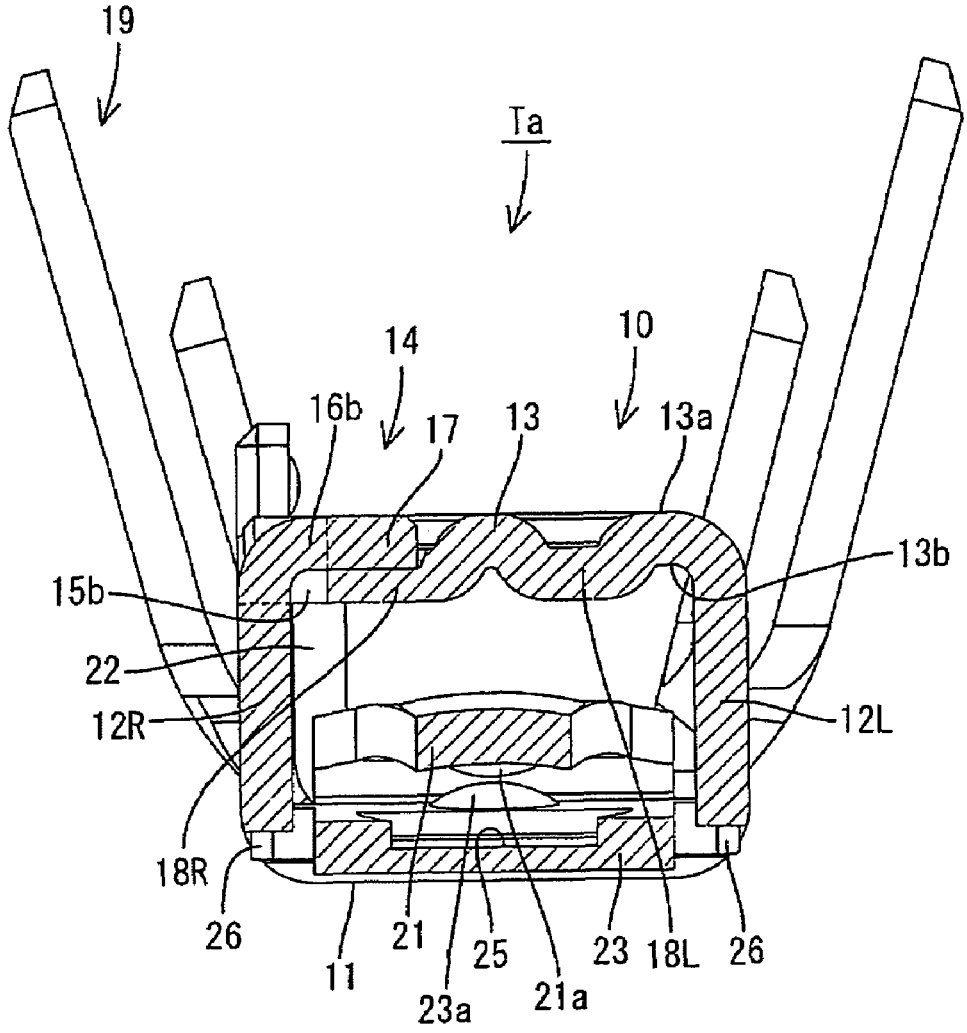
FIG. 7 is a section along Y-Y of FIG. 4.
Figure 8:
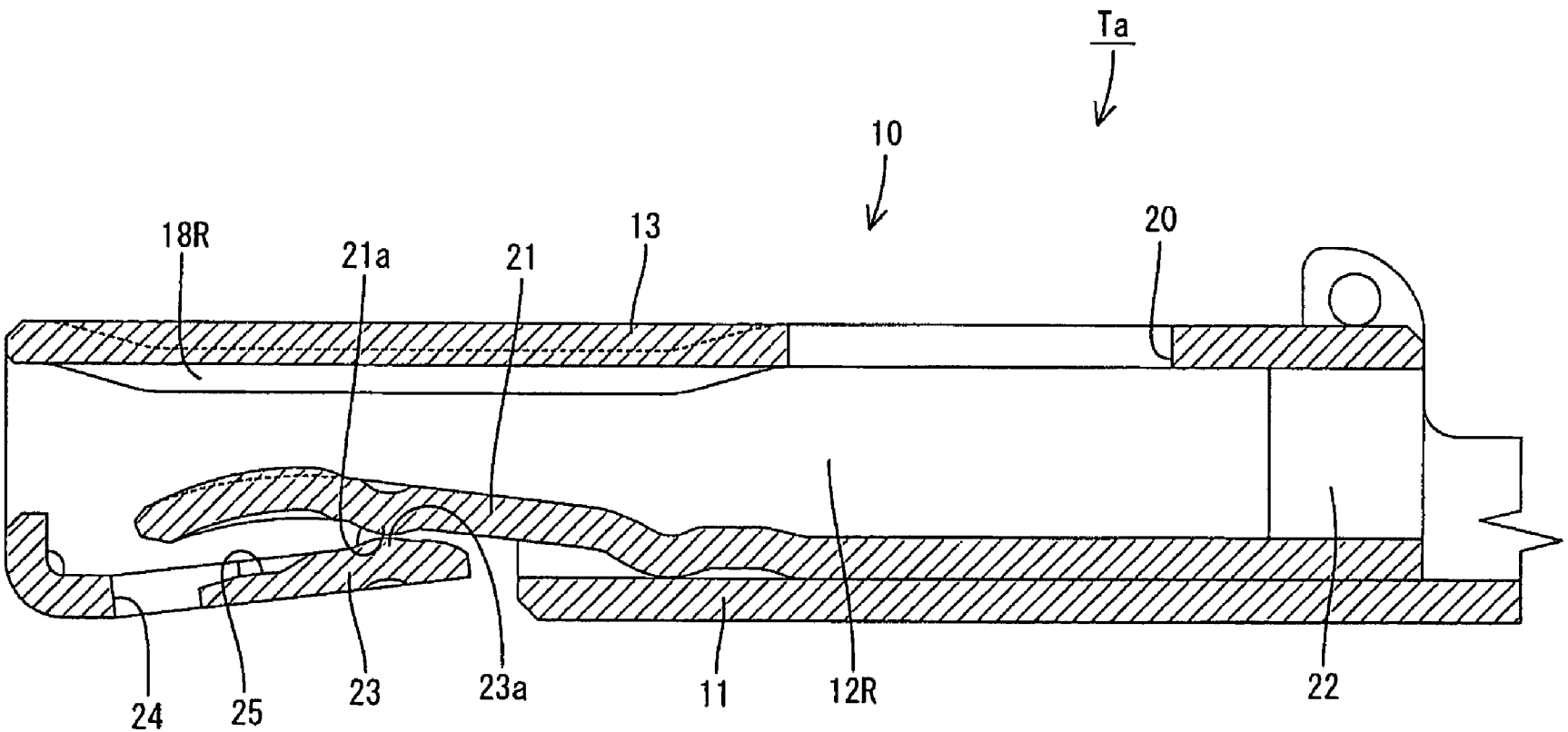
FIG. 8 is a vertical section of a rectangular tube portion.
Figure 9:
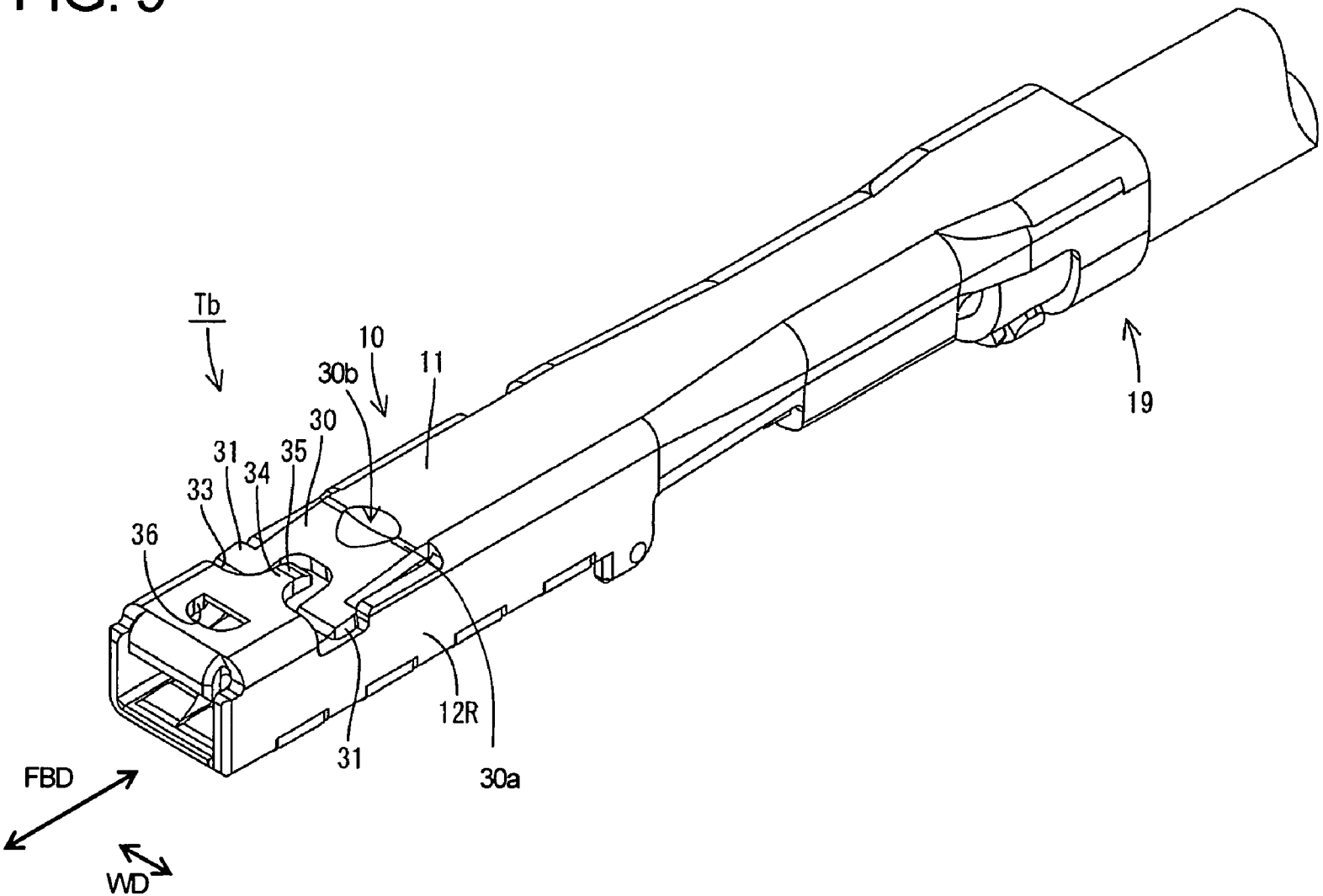
FIG. 9 is a perspective view of a second embodiment when obliquely viewed from front.
Figure 10:
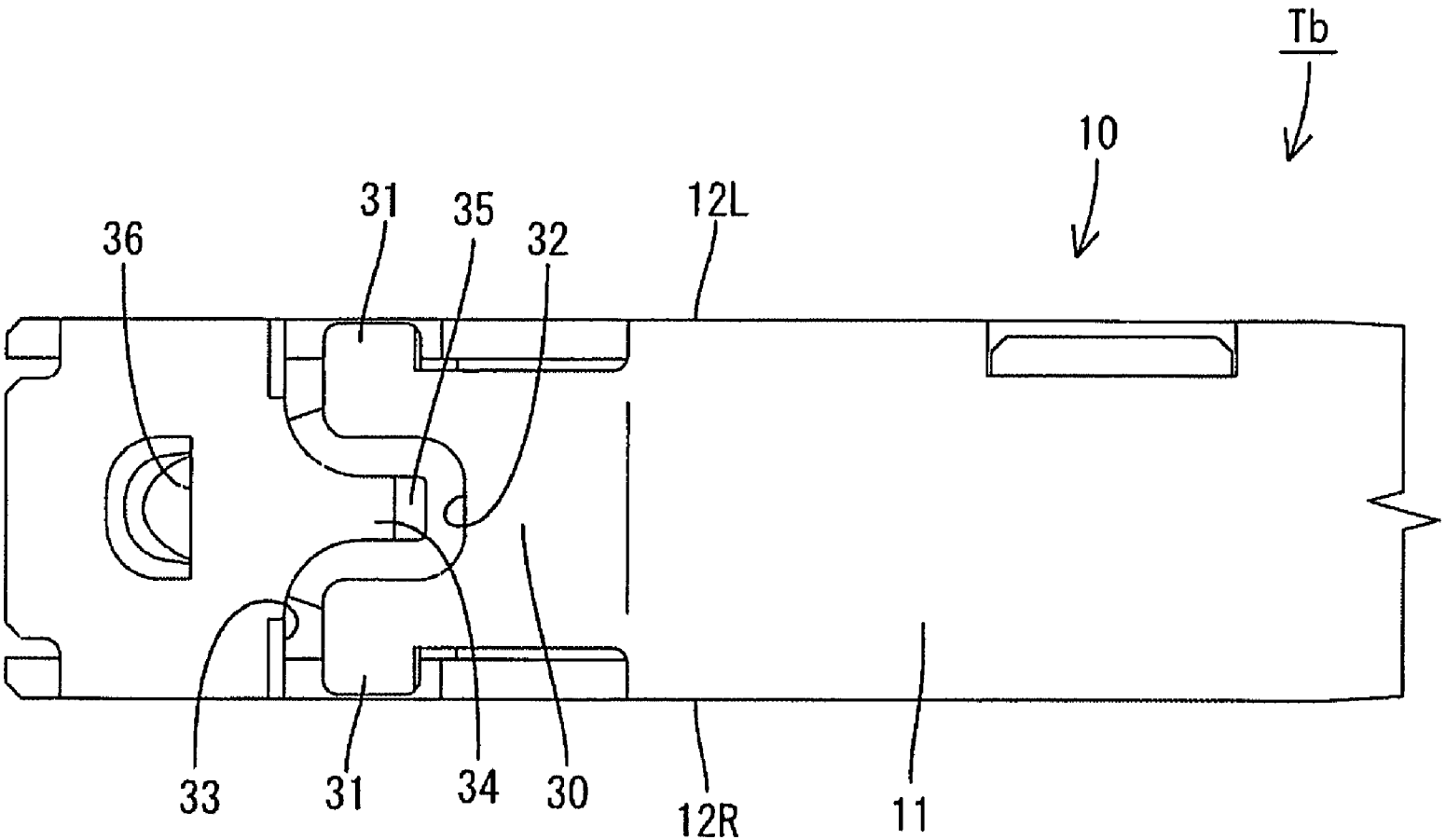
FIG. 10 is a bottom view of a rectangular tube portion.
Figure 11:
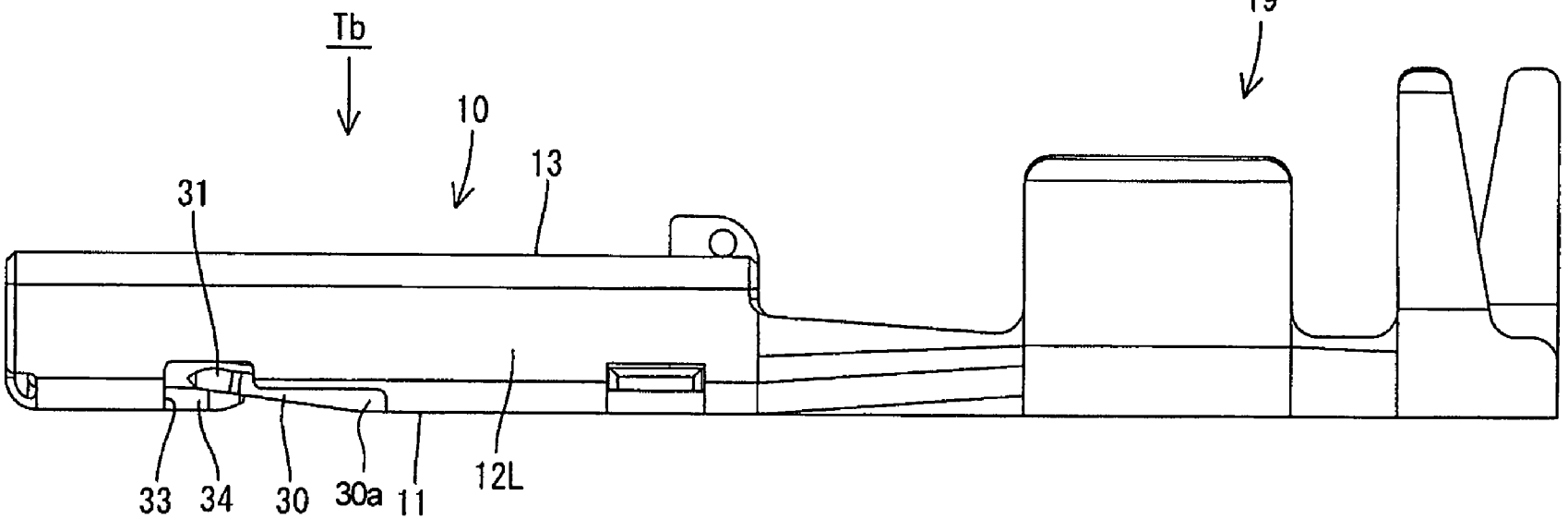
FIG. 11 is a side view of the second embodiment.
Figure 12:
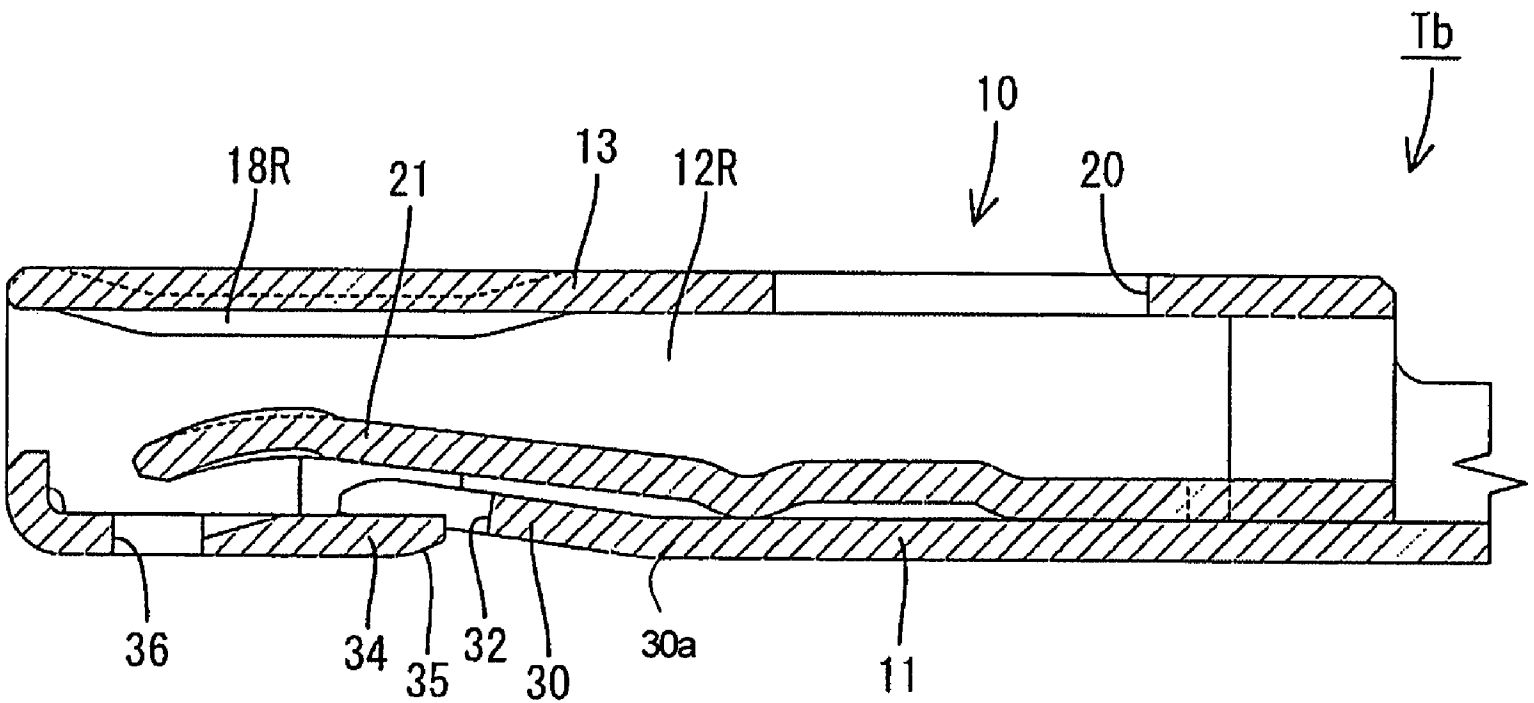
FIG. 12 is a vertical section of the rectangular tube portion.
Figure 13:
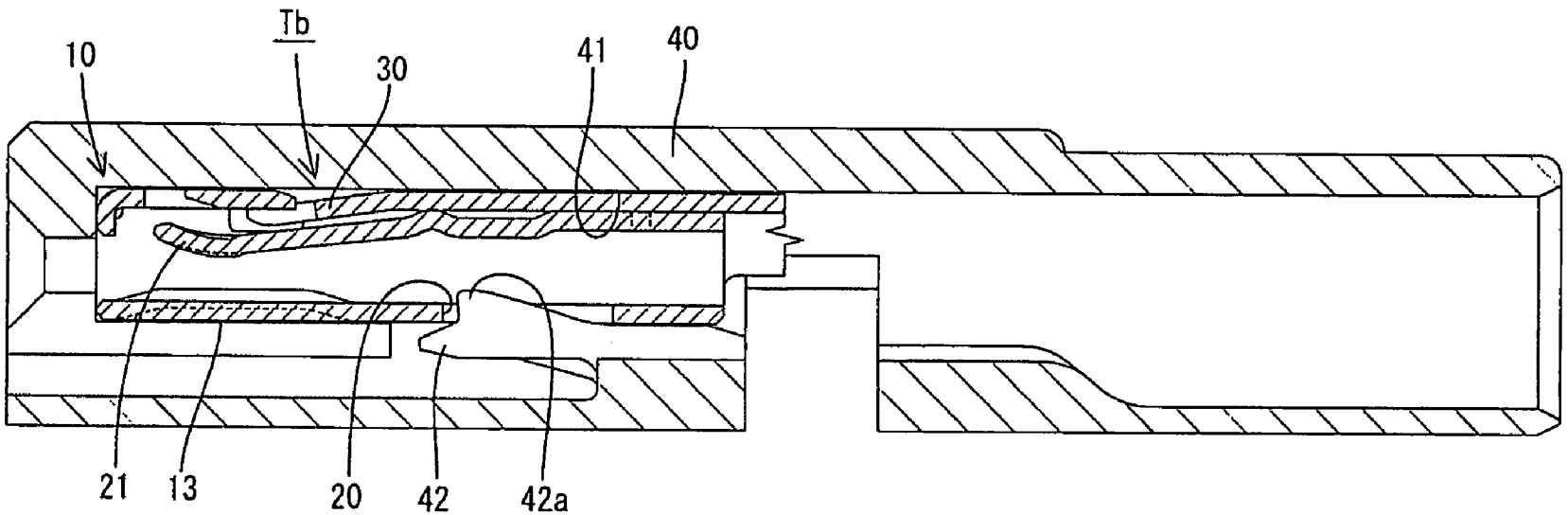
FIG. 13 is a vertical section showing a state where a terminal fitting is properly inserted into a connector housing.

A terminal fitting according to a first embodiment of the invention is identified by Ta in FIGS. 1 to 8. The terminal fitting Ta is formed by punching and/or cutting a conductive metal plate material P into a specified shape and then bending, folding, embossing, cutting and/or pressing the metal plate material P to define the terminal fitting Ta that is long and narrow and long in forward and backward directions FBD. A rectangular tube 10 is formed at the front of the terminal fitting Ta and is hollow in forward and backward directions FBD. A crimping portion 19 is defined at a rear and has open barrels that can be crimped, bent or folded into connection with a wire W.

The tube 10 has a substantially rectangular cross-section defined by a bottom plate 11, a left side plate 12L, a right side plate 12R, an upper plate 13 and a pressing portion 14. The bottom plate 11 is narrow and long in forward and backward directions FBD. The left and right side plates 12L and 12R also are long and narrow in forward and backward directions FBD and project up at right angles from the respective left and right edges of the bottom plate 11. The upper plate 13 too is long and narrow in forward and backward directions FBD and extends substantially normally from the upper edge of the left side plate 12L substantially parallel with the bottom plate 11. An extending end of the upper plate 13 is placed on the upper end surface of the right side plate 12R from above.

Notches are formed at the extending end of the upper plate 13 at positions spaced apart in forward and backward directions FBD. Contact projections 15*a* to 15*e* are left at the extending end of the upper plate 13 without being cut and contact the upper end surface of the right side plate 12R. On the other hand, projections 16*a* to 16*f* project up at the upper end of the right side plate 12R at positions corresponding to the notches. The projections 16*a* to 16*f* and the contact projections 15*a* to 15*e* engage to prevent relative displacements of the upper plate 13 and the right side plate 12R in forward and backward directions FBD. The second and third projections 16*b*, 16*c* from the front are substantially continuous with the opposite front and rear ends of a coupling 17 that extends substantially in forward and backward directions FBD along the left edge of the second contact projection 15*b* from the front. The pressing portion 14 is formed by the second and third projections 16*b*, 16*c* and the coupling portion 17 and extends leftward from the upper edge of the right side plate 12R substantially in parallel with the bottom plate 11. In other words, the pressing portion 14 is a substantially U-shape formed by coupling the two projecting portions 16*b*, 16*c* via the coupling 17.

Two embossments 18L, 18R project in and down in a front area of the upper plate 13. The embossments 18L, 18R are long and narrow in forward and backward directions FBD and are arranged substantially side by side. The upper surface of the left embossment 18L is recessed to have a stepped configuration relative to a highest part 13*a* of the upper surface of the upper plate 13 and the lower surface thereof is projected to have a stepped configuration relative to a highest part 13*b* of the lower surface of the upper plate 13.

The upper surface of the right embossment 18R is recessed to have a stepped configuration relative to the highest part 13*a* of the upper surface of the upper plate 13, and is lower or more inward than the upper surface of the left embossment 18L. Further, the lower surface of the right embossment 18R is projected to have a stepped configuration relative to the highest part 13*b* of the lower surface of the upper plate 13 and is at substantially the same height as the lower surface of the left embossment 18L. In other words, the right embossment 18R is thinner than the upper plate 13, and the thickness between the upper and lower surfaces of the right embossment 18R is smaller than the thickness of the left embossment 18L. An elevation difference between the upper surface of the right embossment 18R and the highest part 13*a* of the upper surface of the upper plate 13 is substantially equal to the thickness of the pressing portion 14 of the terminal fitting Ta.

The lower surfaces of the contact projections 15*a* to 15*e* at the extending end of the upper plate 13 are substantially continuous and flush with the lower surface of the right embossment 18R at the same height. Further, the upper surfaces of the contact projections 15*a* to 15*e* are higher than the upper surface of the right embossment 18R and at substantially the same height as the upper surface of the left embossment 18L. In other words, the thickness of the contact projections 15*a* to 15*e* at the extending end of the upper plate 13 equals the thickness of the metal plate material P.

The coupling 17 of the pressing portion 14 is arranged to correspond to the right embossment 18R with respect to width direction WD. The coupling 17 is fit into a recess in the upper surface of the right embossment 18R so that the lower surface of the coupling 17 is in surface contact with the upper surface of the right embossment 18R. The upper surface of the coupling 17 is at substantially the same height as the highest part 13*a* of the upper surface of the upper plate 13 when the coupling portion 17 is in contact with the upper surface of the right embossment 18R. In other words, the coupling 17 does not project up from the upper plate 13.

The pressing portion 14 extends from the upper edge of the right side plate 12R substantially normal to the right side plate 12R, substantially parallel with the bottom plate 11 and in contact with the upper surface of the embossment 18R to prevent upward movement of the upper plate 13 and to keep the rectangular tube 10 in a specified rectangular tubular shape. The embossment 18R is formed by recessing the upper surface of the upper plate 13 and projects down in a stepped configuration. Thus, the height of the rectangular tube 10 is reduced by the recessed dimension of the embossment 18R as compared to a case where the pressing portion is placed on the highest part of the upper surface of the upper plate. Further, the embossment 18R is thinned to reduce the height of the rectangular tube 10 even more.

The lower surface of the embossment 18R serves a contact surface with a mating terminal (not shown). Thus, the embossment 18R for reducing the height of the rectangular tube 10 doubles as contact with the mating terminal. Accordingly, the shape of the upper plate 13 is simpler than if the embossment is formed in addition to the contact with the mating terminal.

The lower surface of the right embossment 18R and those of the contact projections 15*a* to 15*e* at the extending end of the upper plate 13 are substantially continuous and flush with each other. Thus, the shape of the upper plate 13 is simpler as compared to a case where the lower surface of the embossment is lower than the lower surface of the extending end of the upper plate having a stepped configuration.

A substantially rectangular locking hole 20 vertically penetrates a rear area of the upper plate 13. A resilient contact piece 21 projects forward in the rectangular tube 10 with an upward inclination and has a rear side placed on the upper surface of the bottom plate 11. A supporting plate 22 extends down from the rear end of the right edge of the upper plate 13 and along the inner surface of the right side plate 12R. The rear end of the resilient contact 21 is continuous with and supported on the bottom edge of a supporting plate 22

A substantially rectangular resilient reinforcing piece 23 is formed at a front end portion of the bottom plate 11 by cutting and bending, and projects back with an upward inclination. The resilient reinforcing piece 23 is arranged at least partly below the resilient contact piece 21, and a rounded contact 23*a* is formed on the upper surface of the rear end extending end of the resilient reinforcing piece 23. On the other hand, a rounded contact 21*a* is formed on the lower surface of the resilient contact piece 21 substantially vertically facing the contact 23*a* of the resilient reinforcing piece 23.

A substantially comb-shaped escaping hole 24 of substantially semicircular cross section vertically penetrates the base end of the resilient reinforcing piece 23. The resilient contact piece 21 deforms downward as the mating terminal is inserted and the front end of the resilient contact piece 21 enters the escaping hole 24 to avoid interference between the front end of the resilient contact piece 21 and the bottom plate 11. A recess 25 is formed in the upper surface of the resilient reinforcing piece 23 from the rear edge of the escaping hole 24 to thin the resilient reinforcing piece 23 towards the back. Further, excessive deformation preventing portions 26 project laterally out from the opposite lateral left and right edges of the rear extending end of the resilient reinforcing piece 23 for engaging the corresponding left and right side plates 12L, 12R and preventing excessive deformation of the resilient reinforcing piece 23 beyond its resiliency limit.

The long narrow mating terminal is inserted into the rectangular tube 10 from the front is held from above and below by the lower surfaces of the left and right embossments 18L, 18R and the resilient contact piece 21 that has been deformed down. The resilient reinforcing piece 23 deforms down together with the resilient contact piece 21 by the contact of both contact portions 21*a*, 23*a*. A specified contact pressure is ensured by resilient restoring forces of the resilient contact piece 21 and the resilient reinforcing piece 23. The resilient contact piece 21 and the resilient reinforcing piece 23 are in contact only at the contact portions 21*a*, 23*a* to achieve a stable resilient deformation and a stable contact pressure. Further, the resilient contact piece 21 and the resilient reinforcing piece 23 extend forward and backward in opposite directions. Thus, a degree of freedom in setting the length can be improved.

A terminal fitting according to a second embodiment of the invention is identified by Tb in FIGS. 9 to 14. Elements of the terminal fitting Tb that are similar to the first embodiment are identified by the same reference numerals, are not described again.

The terminal fitting Tb has a resilient reinforcing piece 30 formed preferably by cutting and bending part of the bottom plate 11 to project forward with an inward or upward inclination. The resilient reinforcing piece 30 is below the resilient contact piece 21. Excessive deformation preventing portions 31 project laterally out from the left and right edges of the front end of the resilient reinforcing piece 30 and engage the left and right side plates 12L, 12R to prevent excessive deformation of the resilient reinforcing piece 30 beyond its resiliency limit. The resilient reinforcing piece 30 is connected continuously to the bottom plate 11 via a bent portion 30*a* and is inclined to the bottom plate at an obtuse angle. Further, at least one embossment 30*b* is provided at the bent portion 30*a* to reinforce the resilient locking piece 30.

A substantially rectangular escaping recess 32 is formed in a widthwise intermediate position of the front end portion of the resilient reinforcing piece 30. A guiding projection 34 is formed by cutting and/or bending a portion of the bottom plate 11 forward of opening 33 left in the bottom plate 11 by forming the resilient reinforcing piece 30. The guiding projection 34 is substantially coplanar with the bottom plate 11 and is at least partly insertable into the escaping recess 32 of the resilient reinforcing piece 30. A slanted surface 35 is formed preferably by obliquely cutting the lower rear edge of the guiding projection 34. Further, an escaping hole 36 vertically penetrates a front end portion of the bottom plate 11. The front end of the resilient contact piece 21 enters the escaping hole 36 to avoid interference with the bottom plate 11 when the resilient contact piece 21 is deformed out down by a mating terminal.

The terminal fitting Tb of the second embodiment is inserted upside down into a cavity 41 in a connector housing 40. A resiliently deformable lock 42 is cantilevered forward along the bottom surface of the cavity 41. The upper plate 13 of the rectangular tube 10 deforms the lock 42 down and out during the insertion process. However, the lock 42 is restored resiliently when the terminal fitting Tb is inserted completely so that a retaining projection 42*a* on the upper surface of the lock 42 engages the front edge of a locking hole 20. The terminal fitting Tb is retained by this engagement (see FIG. 13).

A withdrawal jig (not shown) can be inserted from the front to push the leading end of the lock 42 out down to withdraw the inserted terminal fitting Tb. Thus, the lock 42 is disengaged from the locking hole 20 to free the terminal fitting Tb from the retained state. The terminal fitting Tb then may be pulled backward while keeping the lock 42 deformed.

Because of miniaturization, the terminal fitting Tb might be inserted into the cavity 41 in an improper posture, e.g. a vertically inverted posture. In such a case, the bottom plate 11 of the rectangular tube 10 keeps the lock 42 deformed and the terminal fitting Tb can be withdrawn without using the withdrawal jig. The withdrawn terminal fitting Tb may be inserted again in a proper posture.

Upon withdrawing the terminal fitting Tb inserted in the vertically inverted posture, the resilient reinforcing piece 30 passes the lock 42 and immediately thereafter the opening 33 left by forming the resilient reinforcing piece 30 passes the lock 42. The resilient reinforcing piece 30 is cantilevered obliquely forward toward the inside of the rectangular tube 10 from the outer surface of the bottom plate 11. Thus, the front edge of the opening 33 might catch the retaining projection 42*a* of the lock 42 held in contact with the lower surface of the resilient reinforcing piece 30.

Figure 14:
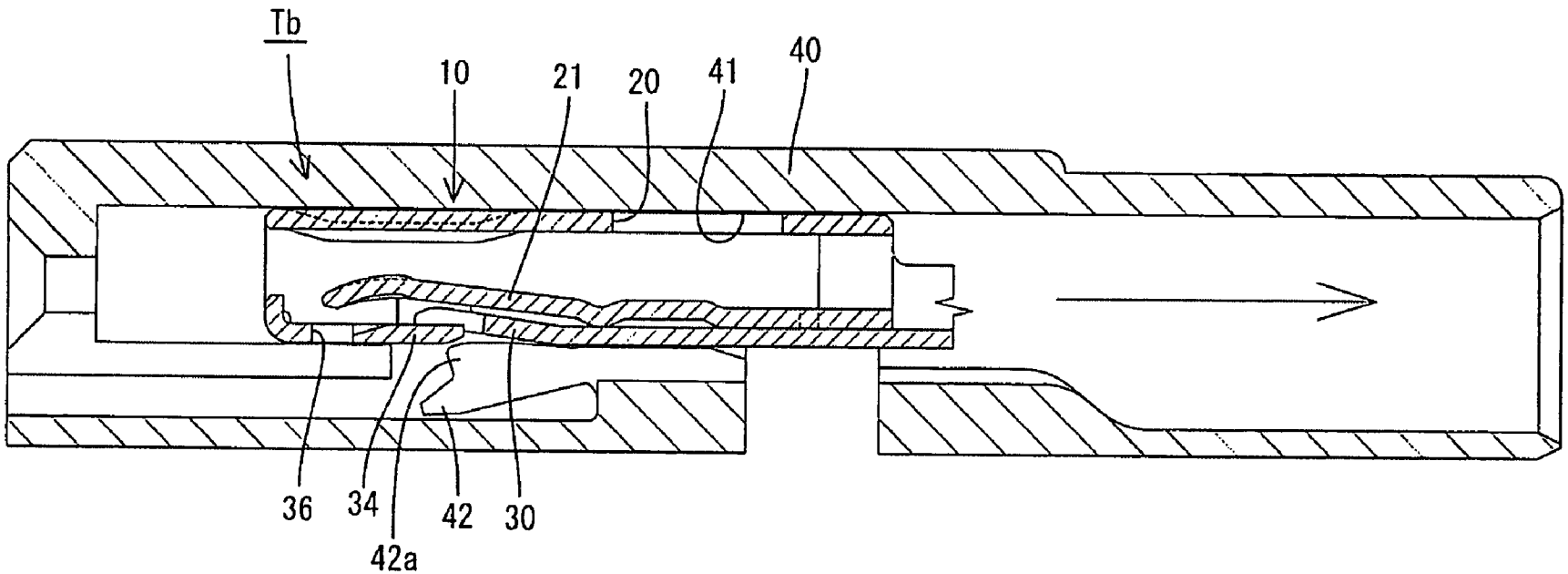
FIG. 14 is a vertical section showing the process of withdrawing the terminal fitting inserted into the connector housing in such a posture vertically inverted from a proper one.

However, the guiding projection 34 projects back from the front edge of the opening 33 and enters the escaping recess 32 of the resilient reinforcing piece 30. The rear edge of the guiding projection 34 is substantially coplanar with the bottom plate 11 and is behind the front edge of the resilient reinforcing piece 30. Accordingly, a maximum elevation difference between the lower surface of the resilient reinforcing piece 30 facing the lock 42 and the lower surface of the guiding projection 34 can be suppressed, as compared to a case where no guiding projection is formed. Thus, if the terminal fitting Tb moves further back from a state where the lock 42 contacts the lower surface of the resilient reinforcing piece 30, the guiding projection 34 moves onto the upper surface of the retaining projection 42*a* without the rear edge thereof getting caught, as shown in FIG. 14, and can smoothly pass the lock 42. Further, the slanted surface 35 is formed on the outer rear surface of the guiding projection 34 so that the front edge of the opening 33 will not be caught by the retaining projection 42*a*.

Figure 15:
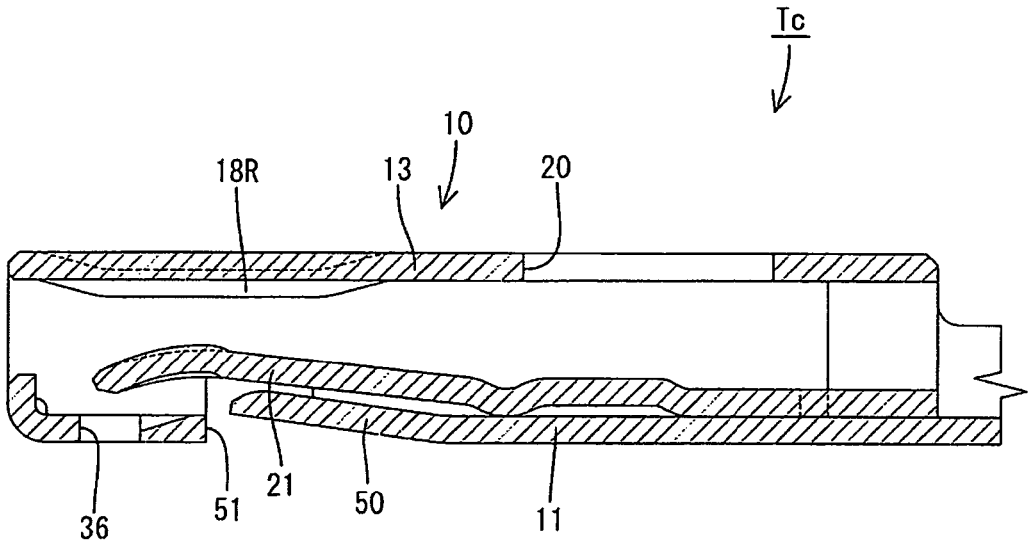
FIG. 15 is a vertical section of a rectangular tube portion of a third embodiment.
Figure 16:
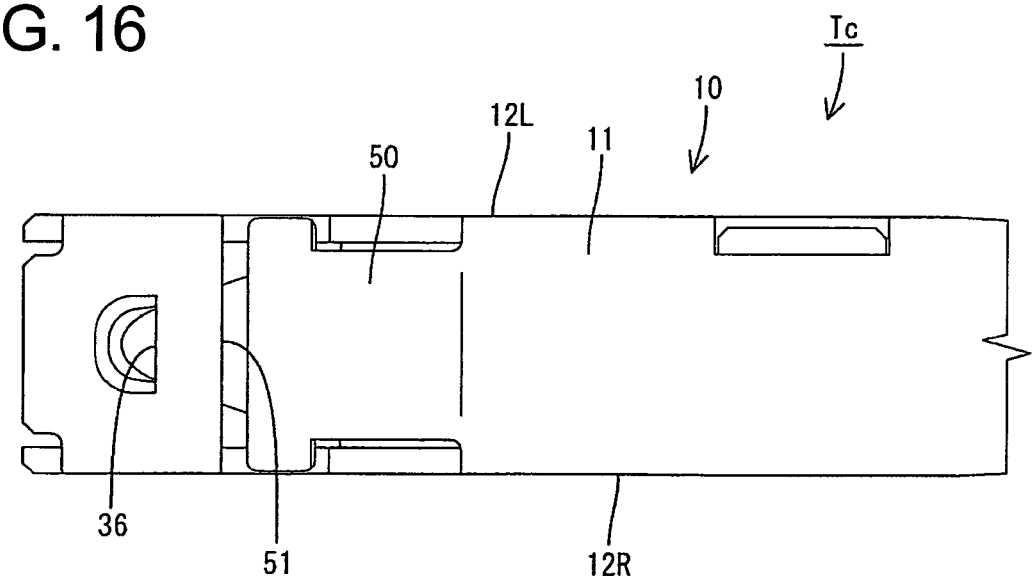
FIG. 16 is a bottom view of the rectangular tube portion.

A terminal fitting of a third embodiment of the invention is identified by Tc in FIGS. 15 and 16. The terminal fitting Tc of the third embodiment differs from the second embodiment in part of the bottom plate 11 and a resilient reinforcing piece 50. Since the other construction is similar or same as in the second embodiment, the similar or same structure is identified by the same reference numerals and functions and effects thereof are not described.

In the third embodiment, the bottom plate 11 is not formed with means corresponding to the guiding projection 34 of the second embodiment. Accordingly, the front edge of an opening 51 left by forming the resilient reinforcing piece 50 by cutting and bending is before the front edge of the resilient reinforcing piece 50. Further, since the guiding projection 34 is not formed, the resilient reinforcing piece 50 is not formed with means corresponding to the escaping portion 32 of the second embodiment.

Figure 17:
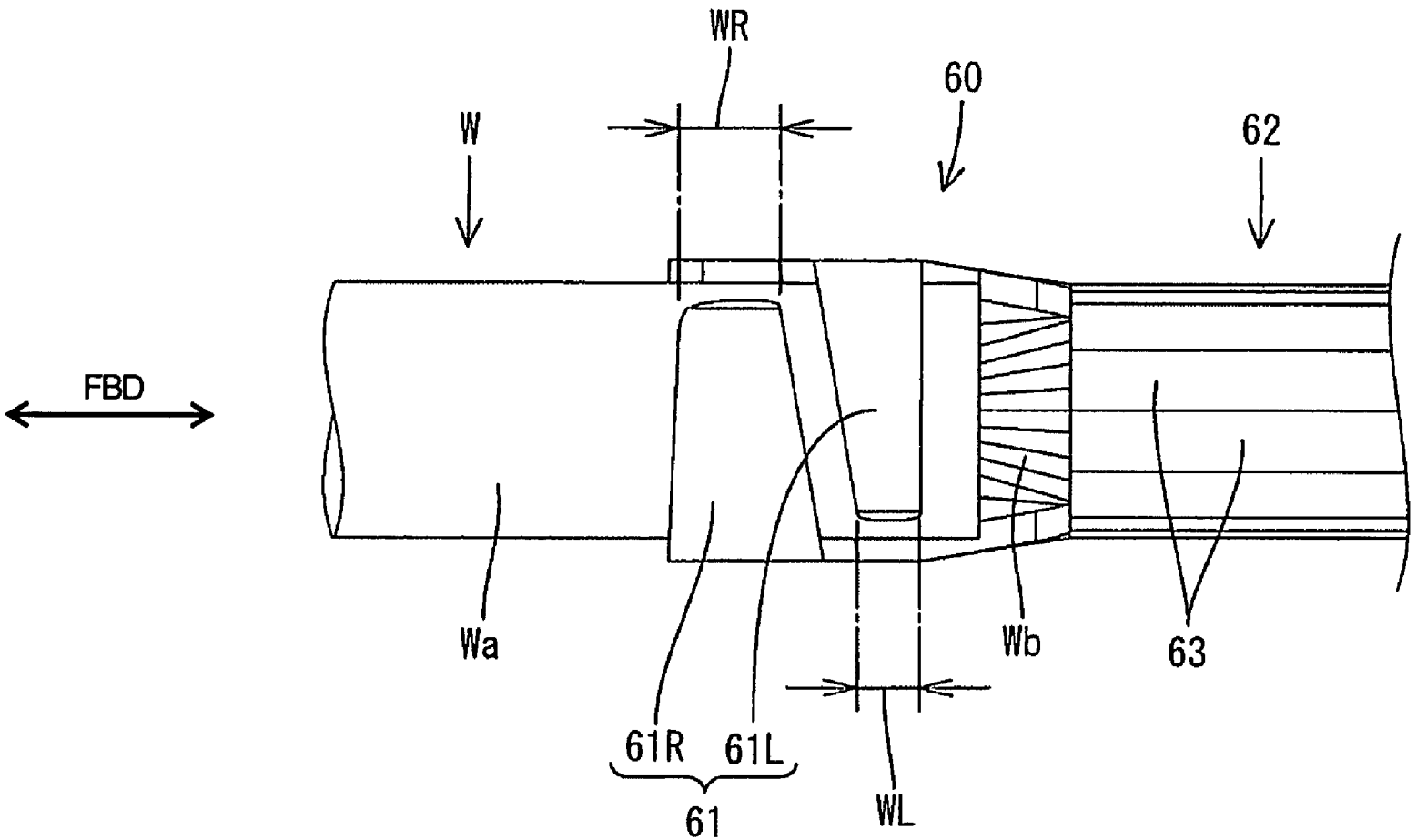
FIG. 17 is a plan view of a crimping portion of a fourth embodiment.

A fourth preferred embodiment of the invention is described with reference to FIG. 17. The fourth embodiment is applicable to the terminal fittings Ta, Tb, Tc of the above first to third embodiments and is featured by at least one crimping portion 60 in the form of an open barrel.

The crimping portion 60 of the fourth embodiment has an insulation barrel 61 with left and right crimping pieces 61L, 61R to be crimped, bent or folded into connection with an insulation coating Wa of a wire W, and a wire barrel 62 having left and right crimping pieces 63 to be crimped, bent or folded into connection with a core Wb exposed by stripping the insulation coating Wa of the wire W. The left and right crimping pieces 61L, 61R of the insulation barrel 61 are offset in forward and backward directions FBD to locate the right crimping piece 61L behind the left crimping piece 61L when the crimping pieces 61L, 61R are crimped, bent or folded around the wire W.

A backward pulling force acts on the wire W acts on the insulation barrel 61. The right and rearward crimping piece 61R resists most of drag against the pulling force. A load resulting from this pulling force is taken into account in this embodiment, and the width WR of the right and rearward crimping piece 61R in forward and backward directions FBD is set larger than the width WL of the left and forward crimping piece 61L in forward and backward directions FBD. Alternatively or additionally the thickness of the right and rearward crimping piece 61R is set larger than the thickness of the left and forward crimping piece 61L by thinning the left crimping piece 61L. In other words, the strength (rigidity) of the rear crimping piece 61R is increased as compared to that of the front crimping piece 61L without changing the dimension of the entire insulation barrel 61 in forward and backward directions FBD. This prevents deformation of the crimping piece 61R upon the action of a backward pulling force, wherefore wire retaining performance by the crimping portion 60 has good reliability.

The invention is not limited to the above described and illustrated embodiments. For example, the following embodiments also are embraced by the technical scope of the present invention as defined by the claims.

Two embossments are arranged substantially side by side in the width direction in the foregoing embodiments. However, three or more embossments may be arranged side by side in the width direction or only one embossment may be formed according to the present invention.

Only the embossment is thinned in the foregoing embodiments. However, both the embossment and the pressing portion may be thinned or only the pressing portion may be thinned according to the invention.

The lower surfaces of the embossments and the lower surface of the extending end of the upper plate are substantially continuous and flush with each other in the foregoing embodiments. However, the lower surfaces of the embossments may be lower than that of the extending end of the upper plate to have a stepped configuration according to the present invention.

Although the embossments double as contacts with the mating terminal in the foregoing embodiments, the embossment may be formed in addition to the contacts with the mating terminal according to the invention.

Six notches are formed in the extending end of the upper plate in the first embodiment. However, other numbers of notches may be formed.

Although the pressing portion is substantially U-shaped by coupling the two projecting portions by the coupling in the first embodiment, it may be formed by coupling three or more projecting portions by the coupling or may be in the form of a single plate according to the present invention.

The construction of the second embodiment for causing the guiding projection to project backward substantially flush with the bottom plate from the front edge of the opening left in the bottom plate by forming the resilient reinforcing piece by cutting and bending and causing this guiding projection to at least partly enter the escaping portion at the front end of the resilient reinforcing piece is also applicable to the first embodiment.

The configurations of the bottom plate and the resilient reinforcing piece in the third embodiment are also applicable to the first embodiment.

It should be understood that in the fourth embodiment more than two crimping pieces 61L, 61R may be provided, wherein the rearmost of the plurality of the crimping pieces has an increased strength (rigidity) e.g. by enlarging its width and/or relative thickness as compared to the other, more forwardly arranged crimping pieces.

What is claimed is:

1. A terminal fitting, comprising a tube for receiving a mating terminal, the tube comprising:

a first plate, second and third plates projecting from the opposite lateral edges of the first plate, a fourth plate extending from a distal portion of the second plate and having an extending end placed in contact with a distal end of the third plate, the fourth plate being formed with at least one embossment projecting in to have a stepped configuration, and at least one pressing portion extending from the distal edge of the third plate and placed in contact with an outer surface of the embossment to prevent an outward movement of the fourth plate wherein at least one of the embossment and the pressing portion is thinned.

2. The terminal fitting of claim 1, wherein the pressing portion is substantially parallel with the first plate.

3. The terminal fitting of claim 1, wherein an inner surface of the embossment is disposed to define a contact surface with the mating terminal.

4. The terminal fitting of claim 1, wherein the embossment is thinner than other parts of the fourth plate.

5. The terminal fitting of claim 1, wherein the tube further comprises a resilient contact piece and a resilient reinforcing piece that are in contact only at respective embossed contact portions.

6. The terminal fitting of claim 1, wherein at least one contact projection is provided at least at one of the third and fourth plates for engagement with at least one projection at the other of the third and fourth plates.

7. The terminal fitting of claim 1, further comprising a wire crimping portion comprising a plurality of crimping pieces spaced along the longitudinal direction of the wire, a rearmost crimping a piece having is increased width or thickness dimensions as compared to relatively forward crimping piece for increasing the strength of the rearmost crimping piece as compared to the forward crimping piece.

8. A terminal fitting comprising a tube for receiving a mating terminal, the tube comprising:

a first plate, second and third plates projecting from the opposite lateral edges of the first plate, a fourth plate extending from a distal portion of the second plate and having an extending end placed in contact with a distal end of the third plate, the fourth plate being formed with at least one embossment projecting in to have a stepped configuration, an inner surface of the embossment being disposed to define a contact surface with the mating terminal, and wherein the inner surface of the embossment and an inner surface of an extending end of the fourth plate are substantially continuous and flush with each other, and at least one pressing portion extending from the distal edge of the third plate and placed in contact with an outer surface of the embossment to prevent an outward movement of the fourth plate.

9. A terminal fitting, a tube for receiving a mating terminal, the tube comprising:

a first plate, second and third plates projecting from the opposite lateral edges of the first plate, a fourth plate extending from a distal portion of the second plate and having an extending end placed in contact with a distal end of the third plate, the fourth plate being formed with at least one embossment projecting in to have a stepped configuration, at least one pressing portion extending from the distal edge of the third plate and placed in contact with an outer surface of the embossment to prevent an outward movement of the fourth plate, a resilient contact piece formed in the tube for contacting the mating terminal; and a resilient reinforcing piece substantially adjacent the resilient contact piece, the resilient contact piece and the resilient reinforcing piece being in contact only at respective embossed contact portions, wherein an escaping hole is formed in the resilient reinforcing piece so that when the resilient contact piece is resiliently deformed by the mating terminal, a portion of the resilient contact piece can enter the escaping hole to avoid the interference of the resilient contact piece and one of the plates.

10. A terminal fitting comprising a tube for receiving a mating terminal, the tube comprising:

a first plate, second and third plates projecting from the opposite lateral edges of the first plate, a fourth plate extending from a distal portion of the second plate and having an extending end placed in contact with a distal end of the third plate, the fourth plate being formed with at least one embossment projecting in to have a stepped configuration, and at least one pressing portion extending from the distal edges of the third plate and placed in contact with an outer surface of the embossment to prevent an outward movement of the fourth plate, wherein at least one contact projection is provided at least at one of the third and fourth plates for engagement with at least one projection at the other of the third and fourth plates, wherein inner surfaces of the embossment and the contact projections at the extending end of the fourth plate are substantially continuous and flush with each other.

11. A terminal fitting comprising a tube for receiving a mating terminal, the tube comprising:

a first plate having a resilient reinforcing piece projecting forward with an inward inclination from the first plate, an escaping hole being formed in a widthwise intermediate position of a front portion of the resilient reinforcing piece, and a guiding projection substantially flush with the first plate, a rear end of the guiding projection being behind a front edge of the resilient reinforcing piece and being in the escaping portion of the resilient reinforcing piece second and third plates projecting from the opposite lateral edges of the first plate, and a fourth plate extending from a distal portion of the second plate and having an extending end placed in contact with a distal end of the third plate, the fourth plate being formed with at least one embossment projecting in to have a stepped configuration, and at least one pressing portion extending from the distal edge of the third plate and placed in contact with an outer surface of the embossment to prevent an outward movement of the fourth plate.

12. The terminal fitting of claim 11, further comprising a slanted surface formed by obliquely cutting an outer surface at the rear end of the guiding projection.

13. The terminal fitting of claim 11, further comprising a locking hole is formed at a position substantially opposite the resilient reinforcing piece.

14. The terminal fitting of claim 11, wherein the resilient reinforcing piece comprises at least one excessive deformation preventing portion that is engaged with at least one of the second and third walls for preventing excessive deformation of the resilient reinforcing piece.

15. The terminal fitting of claim 11, wherein at least one of the embossment and the pressing portion is thinned.

* * * * *